United States Patent [19]

Kikuchi et al.

[11] 4,444,808

[45] Apr. 24, 1984

[54] STENCIL PAPER FOR MIMEOGRAPHY AND PROCESS FOR MAKING STENCIL

[75] Inventors: Yoshiki Kikuchi; Haruhiko Moriguchi; Takashi Ohmori; Katsuo Makino, all of Kanagawa, Japan

[73] Assignee: Fuji Xerox Co., Ltd., Tokyo, Japan

[21] Appl. No.: 415,296

[22] Filed: Sep. 7, 1982

[30] Foreign Application Priority Data

Sep. 4, 1981 [JP] Japan ..... 56-138622
Sep. 4, 1981 [JP] Japan ..... 56-138623

[51] Int. Cl.[3] ..... B41N 1/24

[52] U.S. Cl. ..... 427/143; 8/471; 101/128.21; 118/504; 428/138; 428/201; 428/211; 428/212; 428/336; 428/486; 428/488.1; 428/311.3; 428/311.1

[58] Field of Search ..... 33/174 B; 101/128.21; 118/504, 505; 427/143, 264, 271, 272, 287; 428/199, 913, 914, 137, 138, 200, 201, 211, 212, 215, 216, 336, 486, 488, 537; 8/471

[56] References Cited

U.S. PATENT DOCUMENTS 1,885,261 11/1932 Horii ..... 427/143
4,058,644 11/1977 DeVries et al. ..... 8/471

FOREIGN PATENT DOCUMENTS 754482 3/1967 Canada ..... 101/128.21
49-5287 2/1974 Japan ..... 427/143

*Primary Examiner*—Bruce H. Hess
*Attorney, Agent, or Firm*—Sughrue, Mion, Zinn, Macpeak & Seas

[57] ABSTRACT

A stencil paper for mimeography is disclosed. The paper is comprised of a porous base which is permeable to mimeographic ink, having thereon a heat-sensitive layer of a material that is solid at ordinary temperatures but which liquifies upon heating. A process for making a stencil is also disclosed, which comprises placing the stencil paper in contact with a receiving medium and selectively heating the stencil paper to liquify portions of the heat-sensitive layer, and allowing the liquified portions of the heat-sensitive layer to transfer to the receiving medium.

21 Claims, 4 Drawing Figures

STENCIL PAPER FOR MIMEOGRAPHY AND PROCESS FOR MAKING STENCIL

FIELD OF THE INVENTION

The present invention relates to stencil paper for use in mimeographic printing, and more particularly to stencil paper that can be mimeographed by a thermal process and a process for making a stencil for mimeography.

BACKGROUND OF THE INVENTION

Stencil paper for use in mimeographic printing (hereunder simply referred to as stencil paper) is generally made of paraffin-coated Japanese tissue paper or porous but strong Japanese paper coated with gelatin or collodion in castor oil. A stencil is made from the stencil paper by the stylus method, brush method or typewriting method. In accordance with the stylus method, the stylus is pressed against the surface of the stencil paper on a crosshatched steel plate to scrape the oily overcoat. In the brush method, a weakly acidic solution is applied on the gelatin-coated porous paper with a brush and the solution etches away the gelatin layer. In the typewriting method, a typewriter key is caused to impact the stencil paper and scrape selected portions of the oily overcoat. In each of these methods, preparation of stencil is manual and requires a substantial amount of time. Further, in accordance with these methods stencils cannot be made from photos or clippings of newspaper or magazines.

These defects can be eliminated by a discharge type automatic stencil maker. In such an automatic stencil maker, a drum around which the original and a sheet of paper are wound is rotated in order to read the original and simultaneously prepare a stencil. The stencil is prepared by scanning the original in a cylindrical form while a recording is made by discharge breakdown. Although the use of an automatic stencil maker eliminates defects inherent in the above methods, it causes new problems. For example, when a surface layer of the paper is removed by discharge breakdown, it creates a bad odor which pollutes the place where the machine is installed. Furthermore, the stylus used in the discharge breakdown recording must be frequently replaced.

SUMMARY OF THE INVENTION

It is therefore the primary object of the present invention to provide stencil paper that is capable of high-speed preparation of stencils for mimeography by a method other than discharge breakdown recording, and a process for making a stencil.

This object can be achieved using stencil paper comprising a porous base and an overcoat of heat-sensitive material that is solid at ordinary temperatures but which liquifies upon heating. Stencils can be prepared with this paper by selectively applying thermal pulses to the stencil paper to liquify the heat-sensitive material and remove it from the paper.

DETAILED DESCRIPTION OF THE INVENTION

Figure 1:
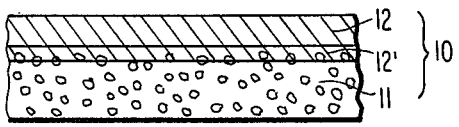
FIG. 1 is a cross section that shows schematically the structure of the stencil paper according to one embodiment of the present invention.

FIG. 1 shows the stencil paper 10 of the present invention. The paper 10 is comprised of a porous base 11 and an overcoat of heat-sensitive material 12. The porous base 11 is preferably made of Japanese tissue paper handmade from the bast fibers having a thickness of about 6 to 100 μm. The overcoat 12 is made of a material that is solid at ordinary temperatures (20°–30° C.) but which liquifies upon heating to 45°–150° C., preferably 50°–80° C., more preferably 55°–75° C. Examples of such material are waxes such as paraffin wax and rice wax, and the like. These waxes are coated onto the porous base 11 by hot-melt coating or solvent coating. The thickness of overcoat 12 is generally from 2 to 15 μm, preferably 10 to 15 μm.

Figure 2:
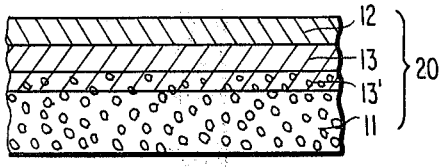
FIG. 2 is a cross section that shows schematically the structure of stencil paper according to a preferred embodiment of the present invention.
Figure 3:
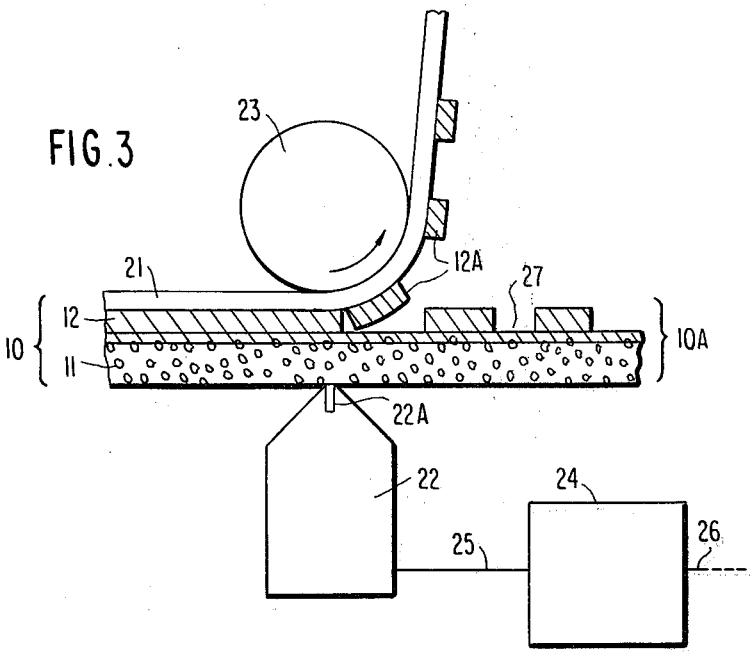
FIG. 3 illustrates how a stencil is made from the stencil paper of FIG. 1.
Figure 4:
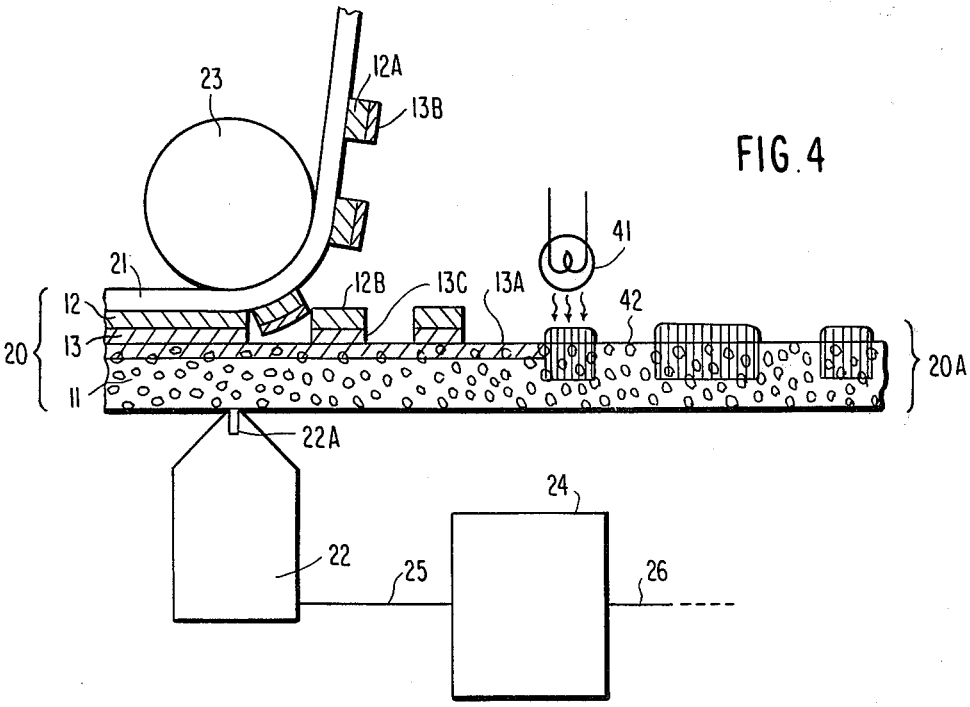
FIG. 4 illustrates how a stencil is made from the stencil paper of FIG. 2.

FIG. 2 shows stencil paper 20 according to a preferred embodiment of the present invention wherein a layer of heat-sublimable material 13 is interposed between the porous base 11 and the overcoat 12. The heat-sublimable layer 13 is made of a material which sublimes upon heating to 45°–150° C., preferably 50°–80° C., more preferably 55°–75° C., such as a nitro dye, monoazo dye, disazo dye and the like. These materials are coated in a thickness of about 2 to 15 μm, preferably 10 to 15 μm, by solvent coating. In this embodiment, the heat-sublimable layer 13 has preferably a sublimation temperature higher than the melting temperature of the overcoat 12. The stencil paper 20 has improved printing properties as compared to the stencil paper 10 without the interlayer 13. This is because, due to the porosity of the base 11, it is unavoidably impregnated with part of the heat-sensitive material from the overcoat 12 during preparation of the stencil paper 10, as indicated by the numeral 12' in FIG. 1. Therefore, the resulting stencil 10A shown in FIG. 3 is comprised of such stencil paper carrying the heat-sensitive material on the area through which mimeographic ink should permeate (this area is hereunder referred to as the exposed area). Whereas the heat-sensitive layer 12 can be completely prevented from being absorbed in the porous base 11 by providing the heat-sublimable layer 13. While the heat-sublimable material is absorbed in the porous base 11 during preparation of the stencil paper 20, as indicated by the numeral 13' in FIG. 2, the absorbed heat-sublimable material can be easily removed from the exposed area of the resulting stencil 20A by heating as shown in FIG. 4.

The overall thickness of the stencil paper of the present invention is determined by the necessary strength and transferrability to a receiving medium and is generally selected to be within the range of about 10 to 130 μm, preferably 10 to 100 μm, more preferably 10 to 70 μm.

The mechanism of making a stencil from the stencil paper of FIG. 1 is shown in FIG. 3. A receiving medium 21 is superimposed on the overcoat of heat-sensitive material 12. The receiving medium 21 is generally made of paper which may be porous or non-porous. The assembly of the stencil paper 10 and receiving medium 21 is then passed between a thermal head 22 and a backup roller 23 in such a manner that the porous base 11 contacts the thermal head 22. The backup roller 23 presses the receiving medium 21 against the thermal head 22 through the stencil paper 10 and is rotated in the direction of the arrow in FIG. 3 to cause the assembly to move in a predetermined direction (direction of subscanning).

The thermal head 22 is a line type recording device wherein a plurality of heat-generating elements 22A are arranged in a row in a direction (direction of main scanning) normal to the direction of sub-scanning. The thermal head 22 is driven by a drive signal 25 supplied from a thermal head drive circuit 24. The drive signal 25 is produced when the drive circuit 24 is fed with a video signal 26 that is produced by reading with a raster input scanner or an output signal from a word processor. A current is then applied to selected elements 22A to generate heat whereby the corresponding parts of the overcoat of heat-sensitive material 12 is heated through the porous base 11. The heated parts of the overcoat 12 liquify and are transferred onto the receiving medium 21. The stencil paper 10 is subsequently separated from the receiving medium 21 to provide a stencil 10A wherein the porous material is exposed in areas 27 that correspond to transferred portions 12A of the heat-sensitive material. The resulting stencil paper 10A may be immediately used as a stencil. Instead, the stencil paper 10A may be uniformly heated so as to impregnate the porous material with the heat-sensitive material before the sheet is used as a stencil, providing a stronger stencil.

The mechanism of making a stencil from the stencil paper of FIG. 2 is shown in FIG. 4. The receiving medium 21 is superimposed on the heat-sensitive layer 12. The assembly of the stencil paper 20 and receiving medium 21 is passed between a thermal head 22 and a backup roller 23 in the same manner as described above.

Part of the heat-sublimable material of which the layer 13 is made penetrates the surface of the porous base 11 to form a heat-sublimable layer 13A. When the thermal head 22 is driven and thermal pulses are selectively applied to the stencil paper 20, the heated areas 12A of the heat-sensitive layer 12 and the corresponding areas 13B of the heat-sublimable layer 13 are transferred to the receiving medium 21. The heat-sublimable layer 13A is still present in the surface of the porous base 11, and the unheated areas 12B of the heat-sensitive layer and the corresponding areas 13C of the heat-sublimable layer are left on the porous base.

Because the stencil paper is formed in a manner as shown in FIG. 2, none of the heat-sensitive material in the layer 12 permeates into the porous base 11. When the heat is applied by the elements 22A, heated portions of the layer 13 may be sublimed and evaporated or may be transferred to the receiving medium 21 along with portions of the layer 12 which are liquified when heat is applied. Accordingly, by selectively applying heat to the stencil paper 20 all of the heat-sensitive material within the layer 12 is removed from the base 11. None of the heat-sensitive material 12 above the areas where the heat is applied by the element 22A remains on the base 11 or permeates into the base 11.

The resulting stencil 20A is separated from the receiving medium 21 and its surface is heated uniformly with a suitable means such as an infrared lamp 41. By applying the heat of the lamp, the heat-sublimable layer 13A left on the exposed area 42 is completely eliminated through sublimation. On the other hand the heat-sensitive region 12B left on the porous base 11 is melted and diffused to the interior of the base. This increases the penetration of mimeographic ink into the stencil 20A and provides a mimeographic copy with good printing properties.

When the stencil of the present invention is mimeographed with conventional mimeographic ink, copies that faithfully reproduce not only letters but also pictures or photos are obtained. Furthermore, the use of the thermal head enables stencils to be made from the stencil paper at a speed equal to or higher than the automatic discharge type stencil maker. The process of the present invention does not create any bad odor because any unwanted heat-sensitive material is transferred to the receiving medium.

In the process of the present invention, a stencil for mimeography is prepared by a thermal transfer system. Accordingly, if the overcoat of heat-sensitive material 12 has a different color from the receiving medium 21, the transferred pattern on the receiving medium (after it is separated from the stencil paper) presents a recorded image that can be kept as a master copy.

In the embodiments described above, a thermal head 22 includes a plurality of heat-generating elements 22A arranged in a row. However, similar results can be obtained by using a thermal head with a matrix arrangement of heat-generating elements. Therefore, a serial- or line-drive thermal head may be used.

While the invention has been described in detail and with reference to specific embodiment thereof, it will be apparent to one skilled in the art that various changes and modifications can be made therein without departing from the spirit and scope thereof.

What is claimed is:

1. A mimeographic stencil paper comprising:
   - a porous base which is permeable to mimeographic ink,
   - an overcoat, formed on one surface of said base, comprised of a heat-sensitive material that is solid at ordinary temperature but which liquefies upon heating, and
   - a layer comprised of a heat-sublimable material positioned between said base and said overcoat.

2. A mimeographic stencil paper as claimed in claim 1, wherein said heat-sensitive material liquefies upon heating to 45°-150° C.

3. A mimeographic stencil paper as claimed in claim 2, wherein said heat-sensitive material is wax.

4. A mimeographic stencil paper as claimed in claim 1, wherein said heat-sublimable material sublimates upon heating to 45°-150° C.

5. A mimeographic stencil paper as claimed in claim 4, wherein said heat-sublimable material is selected from the group consisting of a nitro dye, a monoazo dye and a disazo dye.

6. A mimeographic stencil paper as claimed in claim 1, wherein said heat-sublimable layer has a sublimation temperature higher than the melting temperature of said overcoat.

7. A mimeographic stencil paper as claimed in claim 1, wherein said heat-sublimable layer is comprised of a nitro dye, a monoazo dye or a disazo dye and said overcoat is comprised of wax.

8. A mimeographic stencil paper as claimed in claim 1, wherein said overcoat has a thickness of 2 to 15 μm.

9. A mimeographic stencil paper as claimed in claim 1, wherein said heat-sublimable layer has a thickness of 2 to 15 μm.

10. A mimeographic stencil paper as claimed in claim 1, wherein said heat-sublimable material is a heat-sublimable dye.

11. A process for making a stencil for mimeography comprising the steps of:

providing a stencil paper comprising a porous base permeable to mimeographic ink having on one surface thereof in sequence a layer comprised of a heat-sublimable material and an overcoat comprised of a heat-sensitive material that is solid at ordinary temperature but which liquefies upon heating;

providing a receiving medium in contact with the heat-sensitive layer;

selectively heating portions of the heat-sublimable layer and the heat-sensitive layer with a thermal head to an extent that the heated portions of the heat-sensitive layer are liquefied;

allowing the liquefied portions of the heat-sensitive layer to transfer to the receiving medium; and uniformly heating the thus treated stencil paper to an extent that the heated portions of the heat-sublimable layer remaining on the base are sublimated.

12. A process for making a stencil as claimed in claim 11, wherein the receiving medium has a different color from the material of the heat-sensitive layer.

13. A process for making a stencil as claimed in claim 11, wherein the receiving medium is provided against the heat-sensitive layer by means of a backup roller which continually rotates during the selective heating.

14. A process for making a stencil as claimed in claim 11, wherein said heat-sublimable material is a heat-sublimable dye.

15. A process for making a stencil as claimed in claim 11, wherein said heat-sensitive material liquefies upon heating to 45°–150° C.

16. A process for making a stencil as claimed in claim 15, wherein said heat-sensitive material is a wax.

17. A process for making a stencil as claimed in claim 11, wherein said heat-sublimable material sublimates upon heating to 45°–150° C.

18. A process for making a stencil as claimed in claim 17, wherein said heat-sublimable material is selected from the group consisting of a nitro dye, a monoazo dye and a disazo dye.

19. A process for making a stencil as claimed in claim 11, wherein said heat-sublimable layer has a sublimation temperature higher than the melting temperature of said overcoat.

20. A process for making a stencil as claimed in claim 11, wherein said overcoat has a thickness of 2 to 15 μm.

21. A process for making a stencil as claimed in claim 11, wherein said heat-sublimable layer has a thickness of 2 to 15 μm.

* * * * *